US010085493B2

(12) United States Patent
Frost et al.

(10) Patent No.: US 10,085,493 B2
(45) Date of Patent: Oct. 2, 2018

(54) COMBINATION ATHLETIC JERSEY AND HOODED SWEATSHIRT

(71) Applicant: JRACKS LLC, Coral Springs, FL (US)

(72) Inventors: B. Robert Frost, Coral Springs, FL (US); Matthew B. Friedopfer, Coral Springs, FL (US)

(73) Assignee: JRACKS LLC, Coral Spring, FL (US)

( * ) Notice: Subject to any disclaimer, the term of this patent is extended or adjusted under 35 U.S.C. 154(b) by 45 days.

(21) Appl. No.: 15/222,909

(22) Filed: Jul. 28, 2016

(65) Prior Publication Data

US 2018/0027889 A1 Feb. 1, 2018

(51) Int. Cl.
*A41D 1/04* (2006.01)

(52) U.S. Cl.
CPC ..... *A41D 1/04* (2013.01); *A41D 2200/20* (2013.01); *A41D 2300/50* (2013.01); *A41D 2500/10* (2013.01); *A41D 2500/50* (2013.01); *A41D 2600/10* (2013.01)

(58) Field of Classification Search
CPC .. A41D 1/04; A41D 2200/20; A41D 2300/50; A41D 2500/10; A41D 2500/50; A41D 2600/10
See application file for complete search history.

(56) References Cited

U.S. PATENT DOCUMENTS

| | | | | | |
|---|---|---|---|---|---|
| 2,121,304 | A | * | 6/1938 | Rosenbloom | A41D 1/04 2/103 |
| D114,751 | S | * | 5/1939 | Cohen | D2/751 |
| 6,047,404 | A | * | 4/2000 | Blanks, I | A41D 15/00 2/108 |
| D584,482 | S | * | 1/2009 | Marsh | D2/717 |
| D625,080 | S | * | 10/2010 | Sanchez, III | D2/750 |
| D628,360 | S | * | 12/2010 | Deacon | D2/717 |
| D635,332 | S | * | 4/2011 | DeRobertis | D2/831 |
| D648,925 | S | * | 11/2011 | Anderson | D2/717 |
| D713,129 | S | * | 9/2014 | Gooch | D2/840 |
| 2014/0317823 | A1 | * | 10/2014 | Hanson | A41D 15/005 2/69 |

* cited by examiner

*Primary Examiner* — Shaun R Hurley
*Assistant Examiner* — Andrew W Sutton
(74) *Attorney, Agent, or Firm* — Nixon & Vanderhye P.C.

(57) ABSTRACT

Garments are provided with an integral athletic jersey (e.g., of a variety having shoulder straps) formed of one fabric material and a hooded portion joined to the jersey at a neckline seam thereof which is formed of a different fabric material. According to certain embodiments, the fabric material forming the jersey portion is a woven fabric of synthetic yarns or blends of synthetic and natural yarns which provide a visual sheen to the jersey, whereas the fabric material forming the hooded portion may be a knit jersey fabric (e.g., a knit fleece of natural cotton yarns and/or yarns of cotton blended with synthetic fibers).

10 Claims, 4 Drawing Sheets

COMBINATION ATHLETIC JERSEY AND HOODED SWEATSHIRT

CROSS-REFERENCE TO RELATED APPLICATION

This application is related to commonly owned U.S. Design patent application Ser. No. 29/572,631 entitled "Design For: COMBINED ATHLETIC JERSEY AND HOODED SWEATSHIRT" filed on Jul. 28, 2016, the entire content of such application being expressly incorporated hereinto by reference.

FIELD

The embodiments disclosed herein relate generally to hooded garments. In especially preferred forms, the embodiments disclosed herein are directed toward hooded garments that include an integral athletic jersey.

BACKGROUND

Sports team jerseys having relatively thin shoulder straps connecting the front and back torso panels are worn in a number of athletic endeavors, notably basketball. Fans desiring to wear such shoulder strap team jerseys during cold weather conditions for casual attire typically must wear the jerseys under an outer jacket for warmth thereby effectively hiding the team logo and the like.

It would therefore be highly desirable if a garment could be provided with resembles a sports team jersey but is an integral part of an outer garment. It is towards providing such a need that the embodiments disclosed herein are directed.

SUMMARY

The embodiments disclosed herein provide an integral athletic jersey formed of one fabric material and a hooded portion joined to the jersey. The athletic jersey and the hooded portion of the garment may be formed of a different material, e.g., different fabric materials or combinations of fabric and non-fabric materials. According to certain embodiments, for example, the material forming the jersey portion may be a woven fabric of synthetic yarns or blended synthetic and natural yarns which provide a visual sheen to the jersey, whereas the fabric material forming the hooded portion may be a knit jersey fabric, for example conventional sweatshirt fleece fabric formed of natural cotton yarns and/or yarns of cotton blended with synthetic fibers (e.g., a blend of cotton and polyester fibers), a denim fabric or a woven fabric of synthetic yarns (e.g., polyester, nylon and the like) as well as blends of natural and synthetic yarns (e.g., blends of cotton and polyester). Alternatively or additionally, the material forming the hooded portion may be a non-fabric material, such as leather. In this manner, the visual appearance of the garment will be that of the woven jersey being layered over a hooded knit sweatshirt.

Some embodiments will be provided with a shoulder strap jersey portion which includes front and rear torso panels and right and left shoulder strap portions which define a continuous generally circular neckline seam and right and left continuous generally circular arm line seams, respectively, and a hooded portion integrally joined to the shoulder strap jersey portion at the neckline seam, wherein the jersey portion and the hooded portion are formed of different fabric materials (e.g., as described briefly above).

Certain embodiments of the garment will include right and left shoulder sections formed of the same material as the hooded portion integrally joined to the right and left shoulder seams, respectively. If provided, the right and left shoulder sections define right and left shoulder seams which may be integrally joined to right and left sleeve sections, respectively. If present, each of the right and left sleeve sections may either be either short or long sleeves.

The hooded portion may include a conventional draw string with the front seam defining the hood opening. The garment may be a pull-over type of garment. Alternatively, the front torso panel of the jersey portion may be split lengthwise and provided with a lengthwise extending zipper for closure (e.g., so as to form a cardigan-type garment).

These and other aspects and advantages of the present invention will become more clear after careful consideration is given to the following detailed description of the preferred exemplary embodiments thereof.

BRIEF DESCRIPTION OF ACCOMPANYING DRAWINGS

The disclosed embodiments of the present invention will be better and more completely understood by referring to the following detailed description of exemplary non-limiting illustrative embodiments in conjunction with the drawings of which:

DETAILED DESCRIPTION

Figure 1:
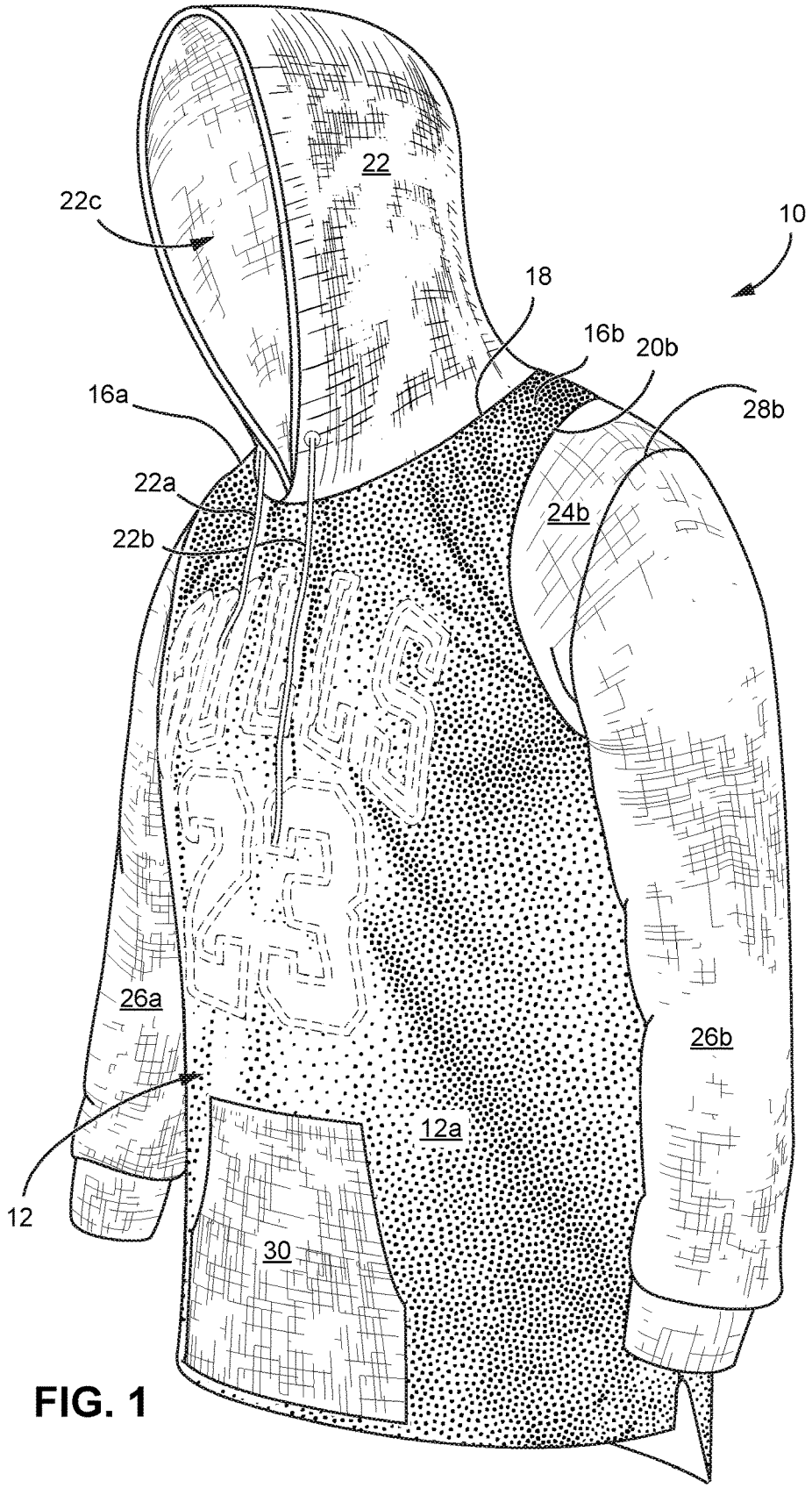
FIG. 1 is a left front perspective view of an embodiment of a combined athletic jersey and hooded sweatshirt.
Figure 2:
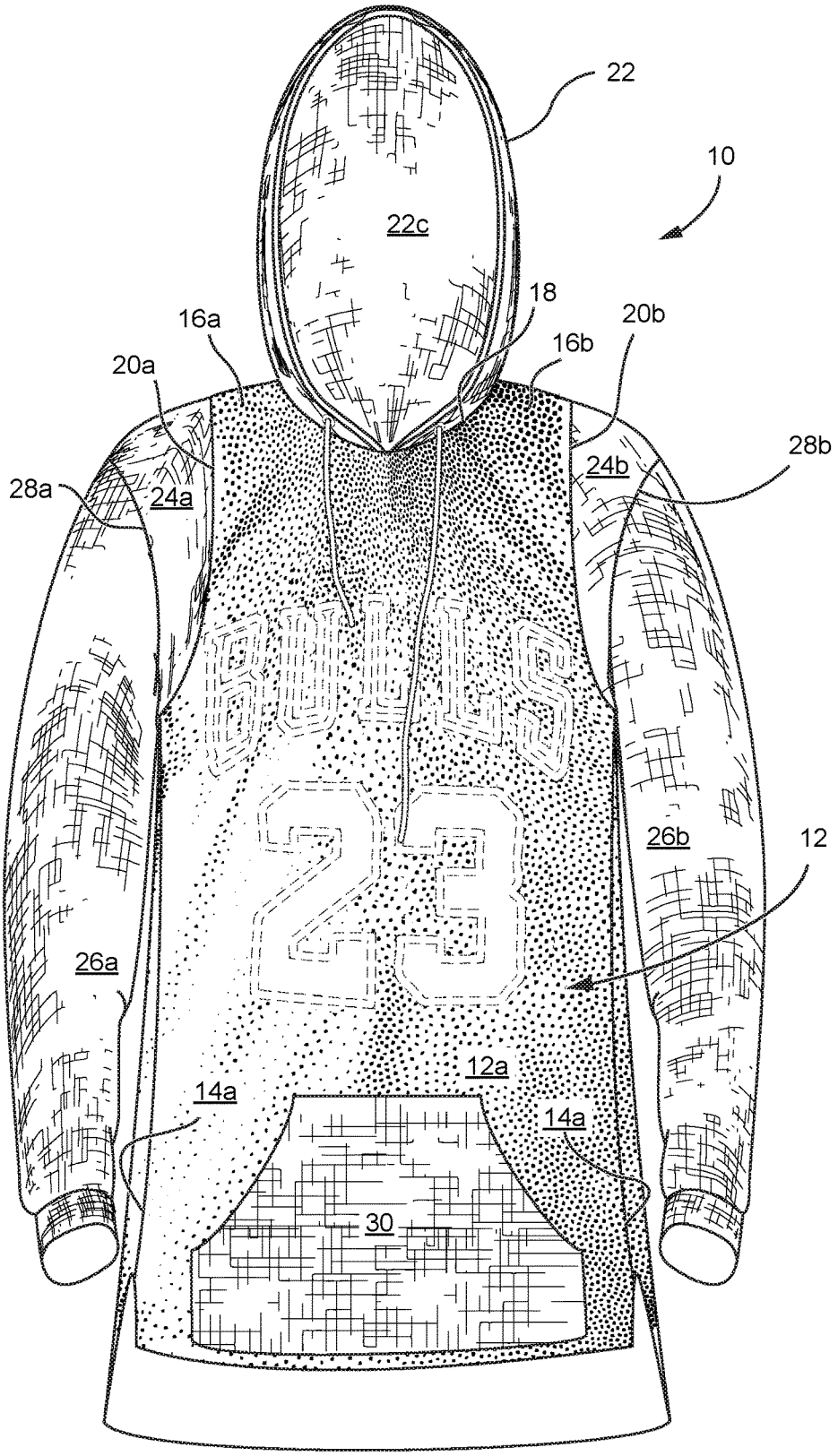
FIG. 2 is a front elevational view thereof.
Figure 3:
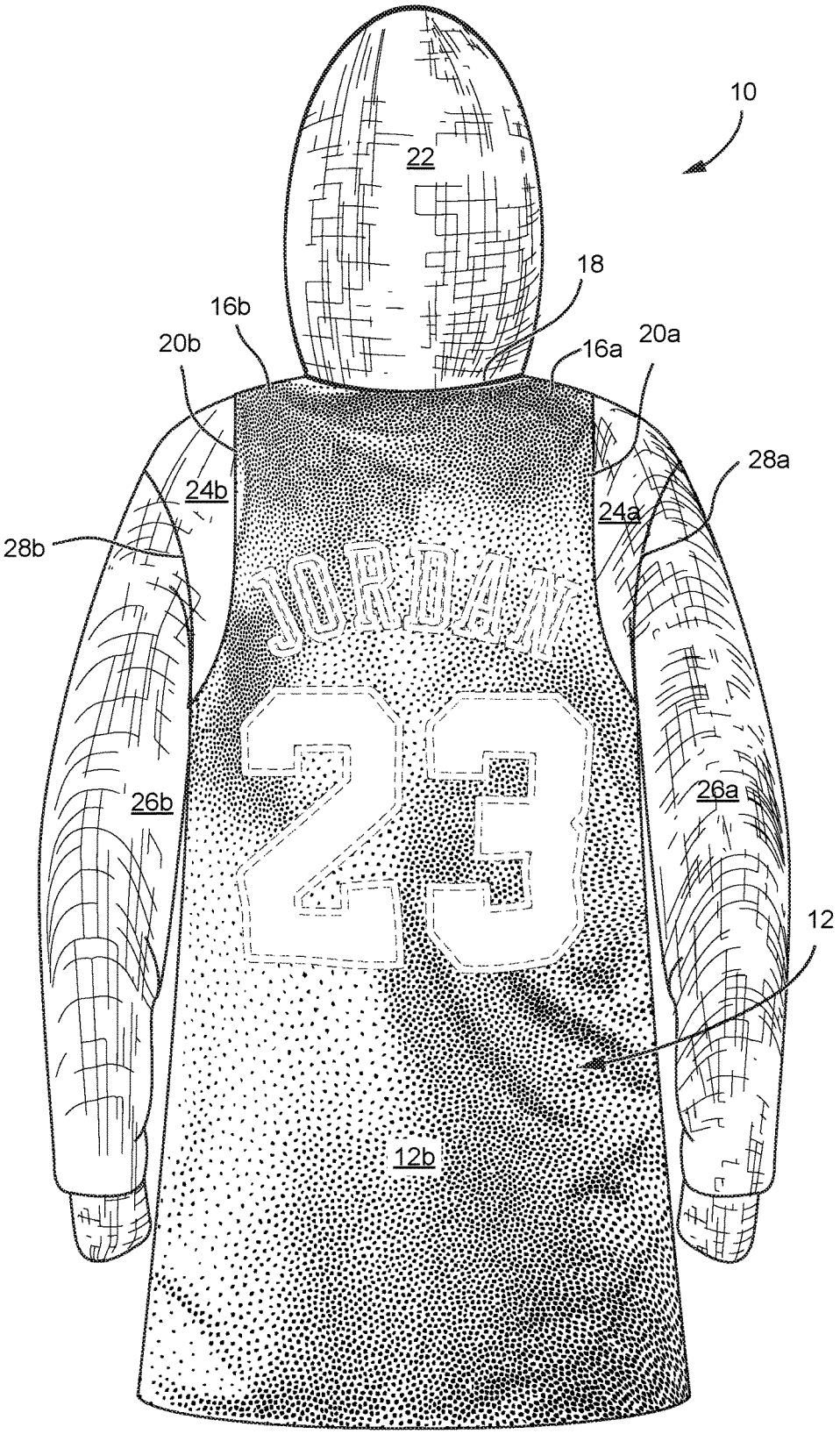
FIG. 3 is a rear elevational view thereof.
Figure 4:
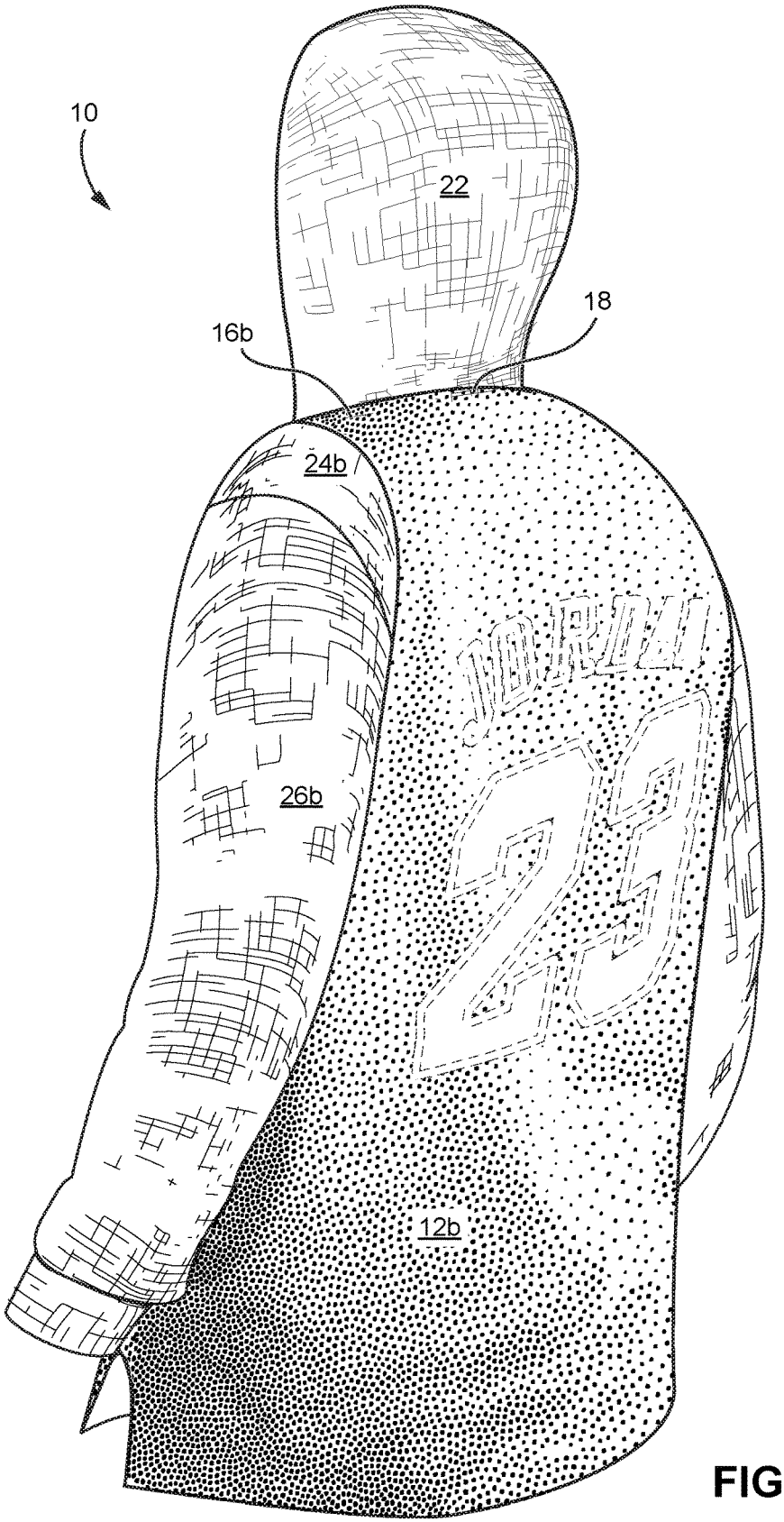
FIG. 4 is a left rear perspective view thereof.

Accompanying FIGS. 1-4 depict a combined jersey and hooded sweatshirt garment 10 in accordance with an embodiment of the invention. As can be seen, the garment 10 includes a shoulder strap athletic jersey portion 12 that may include a team logo and/or other identifying indicia, such as player name and number, as shown by dashed lines. The jersey portion 12 is comprised of front and back torso panels 12*a*, 12*b*, respectively, that are connected to one another along substantially vertically oriented right and left underarm seams 14*a*, 14*b* (see FIG. 2).

Right and left shoulder strap portions 16*a*, 16*b* extend over the wearer's shoulders and are preferably formed as a unitary part of the front and rear torso panels 12*a*, 12*b* so as to define therewith a continuous generally circular neckline seam 18 and right and left continuous generally circular arm line seams 20*a*, 20*b*. Important to the embodiments disclosed herein, the jersey portion 12 is integrally connected to a hooded portion 22 at the neckline seam 18 and to right and left shoulder sections 24*a*, 24*b* and right and left sleeve sections 26*a*, 26*b* at the right and left arm line seams 20*a*, 20*b*, respectively. The right and left shoulder and arm sections 24*a*, 24*b* and 26*a*, 26*b* are connected to one another at right and left shoulder seams 28*a*, 28*b*, respectively.

The presence of the hooded portion 22 and the right and left shoulder and sleeve sections 24*a*, 24*b* and 26*a*, 26*b*, respectively, provide increased warmth to the wearer as such portions are most preferably formed of conventional sweatshirt material (e.g., interlock jersey knit fabric). Alternatively, as noted previously, the material forming the hooded portion 22 and the right and left shoulder and sleeve sections 24*a*, 24*b* and 26*a*, 26*b*, respectively, may be formed of other materials as may be desired by fashion design, for example, leather, denim fabric, polyester blend fabrics and the like. As may be conventional, draw strings 22*a*, 22*b* may be provided within the front seam of the hooded portion 22 defining the opening thereof so as to reduce the size of the opening 22*c* and thereby provided additional warmth and protection to the wearer's face against the elements. Optionally, a hand-warming pouch 30 formed of the same jersey knit sweatshirt material as the hooded portion 22 and, if present the shoulder and sleeve sections 24*a*, 24*b* and 26*a*, 26*b*, respectively, may be attached onto the lower portions of the front torso panel 12*a* near waist of the wearer.

The interior of jersey portion 12 may itself be lined with a suitable liner material, e.g., fleece (not shown), comparable to the interior of the interlock jersey knit fabric that may form the hooded portion 22 and the right and left shoulder and sleeve sections 24*a*, 24*b* and 26*a*, 26*b*, respectively, to thereby provide additional warmth to the wearer. The visible exterior of the jersey portion 12 is however formed of a woven fabric of conventional synthetic yarns that are typically used for athletic jerseys, e.g., nylons, polyolefins, polyesters or the like or blends of such synthetic yarns with natural fibrous yarns (e.g., cotton). As such, the visual appearance of the jersey portion 12 presents a visible sheen as compared to the sweatshirt material (e.g., knit jersey fabric of, for example, cotton and/or a blend of cotton and synthetic fibers) forming the hooded portion 22 and, if present, the right and left shoulder and sleeve sections 24*a*, 24*b* and 26*a*, 26*b*, respectively, to thereby provide a visual appearance of garment layering even though the various components are integrally seemed to one another as described previously. It will be understood that the hooded portion 22 and the right and left shoulder and sleeve sections 24*a*, 24*b* and 26*a*, 26*b*, respectively, do not necessarily need to be formed of the same fabric material (even though forming such components of the same jersey knit fabric material represents one presently preferred embodiment) provided that the distinct visual appearance as compared to the jersey portion 12 is maintained (e.g., so as to not detract from the appearance of an athletic jersey being layered over another garment).

The sleeve sections 26*a*, 26*b* are depicted as being in the form of so-called long sleeves, i.e., the sleeve sections 26*a*, 26*b* cover the entire length of a user's arms to the wrist region. The sleeve sections 26*a*, 26*b* may however be in the form of so-called short sleeves (i.e., whereby the end of the sleeve terminates at a desired location near the user's elbows (e.g., at a location between the shoulder seams 28*a*, 28*b* and the vicinity (either above, at or below) of the wearer's elbow). As yet another alternative, the garment 10 may be sleeveless, e.g., in the form of a hooded vest type garment whereby the sleeve sections 26*a*, 26*b* would be omitted and the shoulder sections 24*a*, 24*b* may or may not be omitted. Thus, the garment 10 may be provided in a number of styles to suit consumer desires.

The jersey portion 12 is depicted in the accompanying FIGS. 1-4 as being a conventional pull-over type of garment. However, the jersey portion 12 could be provided as a cardigan type of garment by splitting the front torso portion 12*a* and including a lengthwise extending front zipper (not shown) to allow closure.

The accompanying FIGS. 1-4 depict a shoulder strap type of jersey portion 12. However, the invention is not to be limited to such an embodiment as other types of athletic jersey's (e.g., full shoulder jerseys of the variety typically worn for soccer, football, hockey and the like) may also benefit from certain attributes and elements of the disclosed embodiments herein.

Therefore, while the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope thereof.

What is claimed is:

1. A combined athletic jersey and hooded garment comprising:

an athletic jersey portion which includes front and rear torso panels and right and left shoulder straps which define a continuous generally circular neckline seam and right and left continuous generally circular arm seams, respectively;

a hooded portion integrally joined to the jersey portion at the neckline seam, right and left shoulder sections formed of the same material as the hooded portion defining right and left outer shoulder seams and being integrally connected to the right and left continuous generally circular arm seams inwardly of the right and left shoulder seams, respectively, and right and left sleeve sections formed of the same material as the hooded portion having upper ends integrally connected to the right and left shoulder seams of the right and left shoulder sections, respectively.

2. The garment as in claim 1, wherein the jersey portion and the hooded portion are formed of different fabric materials.

3. The garment as in claim 1, wherein the fabric material forming the jersey portion is a woven fabric of synthetic yarns, and wherein the fabric material forming the hooded portion is a knit jersey fabric.

4. The garment as in claim 1, wherein the fabric material forming the jersey portion is a woven fabric of synthetic yarns, and wherein the fabric material forming each of the hooded portion and the right and left shoulder sections is a knit jersey fabric.

5. The garment as in claim 1, wherein the fabric material forming the jersey portion is a woven fabric of synthetic yarns, and wherein the fabric material forming each of the hooded portion, the right and left shoulder sections and the right and left sleeve sections is a knit jersey fabric.

6. The garment as in claim 1, wherein each of the right and left sleeve sections is a long sleeve.

7. The garment as in claim 1, wherein each of the right and left sleeve sections is a short sleeve.

8. The garment as in claim 1, wherein the hooded portion includes a draw string.

9. The garment as in claim 1, wherein the garment further comprises a hand-warming pouch formed of the same fabric material as the hooded portion and attached to a lower portion of the front torso panel of the jersey portion.

10. The garment as in claim 9, wherein the fabric material forming the jersey portion is a woven fabric of synthetic yarns, and wherein the fabric material forming each of the hooded portion, the right and left shoulder sections, the right and left sleeve sections and the hand-warming pouch is a knit jersey fabric.

* * * * *